United States Patent [19]

Wardle et al.

[11] Patent Number: 5,015,309

[45] Date of Patent: May 14, 1991

[54] GAS GENERANT COMPOSITIONS CONTAINING SALTS OF 5-NITROBARBITURIC ACID, SALTS OF NITROOROTIC ACID, OR 5-NITROURACIL

[75] Inventors: Robert B. Wardle, Logan; W. Wayne Edwards, Tremonton, both of Utah

[73] Assignee: Morton International, Inc., Chicago, Ill.

[21] Appl. No.: 347,540

[22] Filed: May 4, 1989

[51] Int. Cl.[5] ..... C06B 45/10

[52] U.S. Cl. ..... 149/19.1; 149/19.5; 149/45; 149/61; 149/62

[58] Field of Search ..... 149/19.1, 19.5, 19.6, 149/45, 61, 62

[56] References Cited

U.S. PATENT DOCUMENTS

| | | | |
|---|---|---|---|
| 3,177,101 | 4/1965 | Vriesen | 149/19.5 |
| 3,362,859 | 1/1968 | Sutton et al. | 149/19.5 |
| 3,468,730 | 9/1969 | Gawlick et al. | 149/61 |
| 3,719,604 | 3/1973 | Prior et al. | 149/61 |
| 3,723,205 | 3/1973 | Scheffee | 149/61 |
| 3,839,105 | 10/1974 | Dewitt et al. | 149/19.4 |
| 3,923,804 | 12/1975 | Sitzmann et al. | 149/105 |
| 4,148,674 | 4/1979 | Kehren et al. | 149/2 |
| 4,360,394 | 11/1982 | Portnoy | 149/109.6 |
| 4,369,079 | 1/1983 | Shaw | 149/2 |
| 4,370,181 | 1/1983 | Lundstrom et al. | 149/2 |
| 4,386,979 | 6/1983 | Jackson | 149/61 |
| 4,407,119 | 10/1983 | Biddle | 149/19.1 |
| 4,547,235 | 10/1985 | Schneiter et al. | 149/61 |
| 4,547,342 | 10/1985 | Adams et al. | 280/741 |
| 4,931,112 | 6/1990 | Wardle et al. | 149/62 |
| 4,948,439 | 8/1990 | Poole et al. | 149/61 |

OTHER PUBLICATIONS

"Poly(alkylene carbonates)-Typical Properties", a brochure of Air Products and Chemicals, Inc. Emmaus, PA.

*Primary Examiner*—Edward A. Miller
*Attorney, Agent, or Firm*—Gerald K. White

[57] ABSTRACT

Automotive airbag gas generant formulation providing alternative to commercially used formulations containing sodium azide. The composition comprises from about 25% to about 75% by weight of a heterocyclic compound having the following structure:

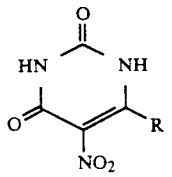

wherein R is selected from
hydrogen,
$-CO_2X$, and
$-OX$ and X is a cation providing an anhydrous salt. The other principal ingredient of the composition is from about 25% to 75% by weight of an anhydrous oxidizing salt having a cation selected from metals of Group I-A of the Periodic Table (except sodium), calcium, strontium, or barium, and an anion which is essentially free of carbon, hydrogen, or halogens. From about 0% to 2% of a binder can be added, if necessary. An automotive airbag inflator containing the composition and a method for generating gas comprising the step of igniting the composition stated above are also disclosed.

17 Claims, No Drawings

GAS GENERANT COMPOSITIONS CONTAINING SALTS OF 5-NITROBARBITURIC ACID, SALTS OF NITROOROTIC ACID, OR 5-NITROURACIL

TECHNICAL FIELD

The present invention relates to gas generant compositions which are burned to provide inflation for automobile airbag restraint systems and other applications.

BACKGROUND ART

Airbag restraint systems are mounted within an automobile to protect its occupants in the event of a severe collision. When a severe collission is sensed, an airbag is very quickly inflated in front of the occupants. When the occupants are thrown forward by the collision, they strike the inflated airbag instead of the steering wheel, dashboard, windshield, or other parts of the automobile. The inflated airbag thus prevents or mitigates the "secondary collision" of occupants with the hard parts of the vehicle. (The secondary collision is the direct cause of most of the injuries to the occupants of the colliding vehicle.)

The most common airbag systems presently in use include an on-board collision sensor, an inflator, and a collapsed, inflatable bag connected to the gas outlet of the inflator. The inflator typically has a metal housing which contains an electrically initiated igniter, a solid phase gas generant composition, and a gas filtering system. Before it is deployed, the collapsed bag is stored behind a protective cover in the steering wheel or in the instrument panel of a vehicle. When the sensor determines that the vehicle is involved in a collision, it sends an electrical signal to the igniter, which ignites the gas generant composition. The gas generant composition burns, generating a large volume of relatively cool gaseous combustion products in a very short time. The combustion products are contained and directed through the filtering system and into the bag by the inflator housing. The filtering system retains all nongaseous combustion products within the inflator and cools the generated gas to a temperature tolerable to the vehicle passenger. The bag breaks out of its protective cover and inflates when filled with the filtered combustion products emerging from the gas outlet of the inflator.

The requirements of a gas generant suitable for use in an automobile airbag are very demanding. The gas generant must burn very fast to inflate the airbag in about 30 milliseconds, but the burn rate must be stable, controllable, and reproducible to insure bag deployment and inflation in a manner which does not cause injury to the vehicle occupants or damage to the bag. The burn rate of the gas generant is thus very critical.

The gas generant must be extremely reliable during the life of the vehicle (ten or more years). Ignition must be certain, and burn rate of the gas generant composition must remain constant despite aging and extensive exposure of the composition to vibration and a wide range of temperatures. The gas generant is protected from moisture when sealed in the inflator, but should still be relatively insensitive to moisture to minimize problems during manufacture and storage of the gas generant and assembly of the inflator, and to insure reliability during the life of the airbag system.

The gas generant must efficiently produce cool, non-toxic, non-corrosive gas which is easily filtered to remove non-gaseous particles, and thus to preclude injury to the vehicle occupants and damage to the bag. Water generation should be minimized to avoid delivering steam to the bag, thereby scalding the bag or the occupants of the automobile.

The requirements of the preceding paragraphs prevent many apparently suitable compositions from being used as airbag gas generants.

The currently available gas generants for airbag inflation are predominantly sodium azide. While such formulations provide a safe and effective airbag gas generator, a gas generant which is free of azides would be desirable.

U.S. Pat. No. 4,360,394, issued to Portnoy on Nov. 23, 1982, discloses the use of 5-nitrobarbituric acid or its trihydrate as 0.5 to 2.0 weight percent of a trinitrotoluene (TNT) composition to suppress crystal growth in the composition after it is cast. Unlike prior TNT compositions, this composition is said not to crack after it is cast. Other unrelated uses for the title compounds are also disclosed in the prior art.

Compounds known to the applicants for uses most nearly connected with those described herein are as follows:

| U.S. Pat. No. | Inventor | Issue Date |
|---|---|---|
| 3,839,105 | DeWitt, et al | 10-01-74 |
| 3,923,804 | Sitzman, et al | 12-02-75 |
| 4,148,674 | Kehren, et al | 04-10-79 |
| 4,369,079 | Shaw | 01-18-83 |
| 4,370,181 | Lundstrom, et al | 01-25-83 |

Of these references, the Sitzman, et al, Kehren, et al, Shaw, and Lundstrom, et al patents show heterocyclic compounds containing carbon and nitrogen as ring elements and relatively little hydrogen.

SUMMARY OF THE INVENTION

Several alternative objectives of the invention are as follows. An azide-free gas generant is desired which burns at a low temperature (about 1400°-1500° K.), burns reliably and reasonably rapidly, does not detonate, and generates non-toxic gases and a minimum of water vapor. The second object is to provide solid combustion products in the form of a clinker which has a melting point near or above the flame temperature, thereby keeping it non-mobile.

A first aspect of the invention is a composition comprising from about 25% to about 75% by weight, preferably from about 40% to about 60% by weight, most preferably about 50% by weight, of an anhydrous heterocyclic compound and from about 25% to about 75% by weight, preferably from about 40% to about 60% by weight, most preferably about 48% by weight, of an anhydrous oxidizing salt. The heterocyclic compound has the following structure:

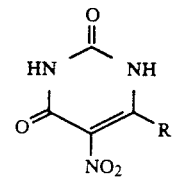

wherein R is selected from
hydrogen,
$-CO_2X$, and
$-OX$ and X is a cation providing an anhydrous salt. The anhydrous oxidizing salt has a cation selected from metals from Group IA of the Periodic Table (except sodium) or from the following Group IIA metals: calcium, strontium, or barium. The anhydrous oxidizing salt has an anion which contains oxygen or nitrogen, and which is essentially free of carbon, hydrogen, or halogens. As needed, the composition may also contain from 0 to about 5% by weight of a binder.

A second aspect of the invention is an automotive airbag inflator. The inflator comprises a metal housing having a gas outlet, a gas generant according to the composition described above within the housing, and a gas filtering system to pass the gaseous combustion products and capture the liquid or solid combustion products of the composition. A third aspect of the invention is a method for generating gas, comprising the step of igniting the composition of claim 1.

DETAILED DESCRIPTION OF THE INVENTION

The heterocyclic compounds previously described have several structural features which give them the potential to act as fuel in gas generating compositions for inflating automotive airbags. The preferred heterocyclic compounds contain nitrogen in the ring structure to maximize the nitrogen content of the gaseous combustion product. Carbonyl functionality is useful because it provides oxygen without hydrogen in an organic structure and lowers the heat of formation of the compound, providing a lower flame temperature. It is desirable to have one nitro substituent attached to a carbon atom of the ring (to increase the burn rate), but more nitros than one make the compound too energetic and unstable. Minimal hydrogen substitution is desired because the formation of water as a combustion product is undesirable. Water has a high heat capacity and readily condenses to liquid form after escaping the filtration system as a gas. Water, therefore, can transmit undesirably large amounts of heat to the deployed airbag and to a person touching the airbag.

Some preferred heterocyclic compounds within the scope of the present invention are ones in which R is —OX as defined previously. These are salts of 5-nitrobarbituric acid. Other heterocyclic compounds useful herein are salts of 5-nitroorotic acid, defined by the preceding formula in which R is $—CO_2X$. A third type of heterocyclic compounds useful herein is 5-nitrouracil, defined by the preceding formula if R is hydrogen. This compound is not a salt. The salts are preferred over 5-nitrouracil because salts have a highly negative heat of formation. This property substantially reduces the flame temperature of the present compositions.

The cations (X) of the heterocyclic salts mentioned above are each selected to provide an anhydrous salt. The oxides of the preferred cations (which form during combustion) also react with any water which is present to form a hydroxide, therefore binding water present in the combustion products and preventing the release of water into the airbag as steam. Accordingly, particular cations contemplated herein for each heterocyclic salt are metals of Group IA of the Periodic Table (except sodium), calcium, strontium, or barium. Other cations useful herein can be readily determined.

The second essential ingredient of the gas generants described herein is an anhydrous oxidizing salt. The cation of the salt is selected from the same group as the cation of the heterocyclic salt, for the same reasons. The anion of the anhydrous oxidizing salt, which typically contributes the oxidizing function, is most broadly characterized as containing nitrogen and oxygen and being essentially free of carbon, hydrogen or halogens. Exemplary anions are nitrate, nitrite, and hexanitrocobaltate—$Co(NO_2)_6^{-3}$. Nitrates and nitrites are preferred because they have a low heat of formation, are inexpensive, and are available with a variety of cations in anhydrous form.

The most preferred heterocyclic compounds are the potassium salts of 5-nitroorotic acid and 5-nitrobarbituric acid. The two most preferred anhydrous oxidizing salts for use herein are potassium nitrate and strontium nitrate.

Some mixtures of heterocyclic compounds and oxidizing salts can be pressed into cohesive pellets which are sufficiently rugged for use in an airbag gas generator without a binder being present. However, it is usually necessary to provide a small proportion of a binder to the composition. One specific binder contemplated herein, which is well-known in this application, is molybdenum disulfide. A second binder useful herein is polypropylene carbonate. (Polypropylene carbonate is a compound having a number average molecular weight of about 50,000 and the following backbone structure.

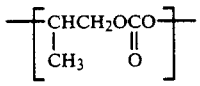

The inventors believe the terminal groups are alkyl groups. A suitable polypropylene carbonate is sold by a joint venture of Air Products and Chemicals, Inc., Emmaus, Pa., ARCO Chemical Co., Philadelphia, Pa., and Mitsui Petrochemical Industries, Ltd., Tokyo, Japan.) If potassium salts are present in the composition, molybdenum disulfide is the preferred binder. Polypropylene carbonate is preferred as a binder when strontium salts are used.

Additional ingredients should be minimized, particular inert ingredients which do not contribute to the volume of gas generated by the composition, or which may introduce deleterious combustion products. One exception is heat conducting fibers, such as about 1% graphite fibers or iron fibers, which increase the burning rate of the composition and transfer heat during combustion.

One preferred composition for use herein consists essentially of an anhydrous salt of 5-nitrobarbituric acid as the heterocyclic compound, strontium nitrate as the anhydrous oxidizing salt, and polypropylene carbonate as a binder. A particularly preferred composition contains about 48% potassium 5-nitrobarbiturate as the heterocyclic compound, about 50% by weight strontium nitrate as the anhydrous oxidizing salt, and about 2% by weight polypropylene carbonate as a binder. The combustion gases of this composition are about 65% carbon dioxide, about 27% nitrogen gas, and about 8% water. A second specific composition useful herein, which provides approximately the same combustion products, is about 50% by weight potassium 5-nitrobarbiturate, about 48% by weight potassium nitrate, and about 2% by weight molybdenum disulfide. The preceding preferred compositions can also be made with the potassium salt of nitroorotic acid in about the same proportions. The nitroorotic acid salt composition provides as combustion products about 13% to 14% water and proportionately less of the other combustion products than the nitrobarbituric acid salt composition. On the other hand, the nitroorotic acid salt composition burns at a somewhat lower temperature.

To manufacture the composition, it is slurried at a concentration of about 40 weight percent in water. The slurry is mixed thoroughly, then spray dried to form about two millimeter diameter prills. The prills are then fed to pellet forming machinery which presses uniformly weighed portions of the composition into discrete pellets.

Another aspect of the invention is an automotive airbag inflator comprising a metal housing having a gas outlet; a particulate gas generating composition according to the previous description disposed within the housing; an igniter disposed within the housing adjacent to the gas generating composition; and a gas filtering system disposed between the composition and the outlet of the metal housing. More specific details and illustrations of the type of inflator contemplated herein are found in U.S. Pat. No. 4,547,342, issued to Adams, et al on Oct. 15, 1985. That patent is hereby incorporated herein in its entirety by reference.

A final aspect of the invention is a method of generating gas, which comprises the step of igniting the composition of claim 1. If gas is to be delivered under pressure, the composition should be placed in a housing as described in the previous paragraph before being ignited.

EXAMPLE 1

25 grams of 5-nitrobarbituric acid were reacted with 11.2 grams of potassium chloride in water and stored overnight to precipitate the insoluble potassium salt of 5-nitrobarbituric acid. The product was filtered from the solution and dried at 100° C. for one hour.

EXAMPLE 2

The ingredients of formula A in Table I were mixed as dry materials, then slurried in water and dried under vacuum at 140° F. (60° C.). Pellets nominally about one-half inch long and one-half inch diameter were prepared; the actual length of each pellet is reported in the data. The sides of each pellet were inhibited with a rubber-based adhesive. Each individual pellet was placed in a one-liter bomb and temperature conditioned by placing the bomb in a bath for 10 minutes at room temperature. The bomb was equipped with a pressure transducer. The contents of the bomb were ignited, and pressure versus time was plotted. Burning time was calculated by determining the interval during which the pressure in the bomb was increasing. Burning rate was determined by dividing the length of each pellet burned by the burning time. The initial and final pressure in the bomb were also recorded. This data is found in Table III.

The examples using formulas B–H were carried out in the same manner, except that the bath temperature used to condition Formula D was 100° F. (38° C.). The data is presented in Tables III–IX, except for Formula H.

Formula A and Formula B have the same ingredients, but in different proportions. Each mixture uses potassium 5-nitrobarbiturate as the fuel. As the data shows, Formula A with equal proportions of the two major ingredients provided a higher burning rate than Formula B. Consequently, Formula A is preferred.

Formulas C and D in Table V and VI each contained the potassium salt of nitroorotic acid. Although the data regarding Formula D is limited, it appears that Formula C has a substantially higher burning rate, and therefore is preferred.

Formula E uses potassium 5-nitrobarbiturate as the fuel with potassium nitrate as the oxidizer. This formulation gives a burn rate slightly higher (7.00 or more cm/sec) than do the formulations with strontium nitrate as the oxidizer.

The results of Formulas F and G made with 5-nitrouracil are presented in Tables VII and IX. Formula H's results are not in a table; the average burning rate of Formula H was 1.796 cm/sec—the best of the three 5-nitrouracil formulas.

TABLE I

| Ingredient | Formula A Wt. % | Formula B Wt. % | Formula C Wt. % | Formula D Wt. % |
|---|---|---|---|---|
| Strontium nitrate | 49.0 | 61.7 | 57.0 | 68.0 |
| Potassium 5-nitrobarbiturate | 49.0 | 36.3 | — | — |
| Potassium salt, nitroorotic | — | — | 43.0 | 32.0 |
| Molybdenum disulfide | 2.0 | 2.0 | — | — |
| Total | 100.0 | 100.0 | 100.0 | 100.0 |

TABLE II

| Ingredient | Formula E Wt. % | Formula F Wt. % | Formula G Wt. % | Formula H Wt. % |
|---|---|---|---|---|
| Potassium nitrate | 48.0 | — | — | — |
| Strontium nitrate | — | 56.0 | 72.9 | 60.0 |
| Potassium 5-nitrobarbiturate | 50.0 | — | — | — |
| 5-nitrouracil | — | 44.0 | 27.1 | 40.0 |
| Molybdenum disulfide | 2.0 | — | — | — |
| Total | 100.0 | 100.0 | 100.0 | 100.0 |

TABLE III (Formula A)

| Length cm. | Burning Time Seconds | Burning Rate cm/sec. | Pressure, N/cm$^2$ Initial | Pressure, N/cm$^2$ Final |
|---|---|---|---|---|
| 1.09 | 0.614 | 1.778 | 623.21 | 759.24 |
| 1.10 | 0.601 | 1.834 | 619.89 | 763.56 |
| Average | 0.608 | 1.806 | 621.56 | 761.40 |
| Range of Burning Rates (cm/sec) | | .056 | | |

TABLE IV (Formula B)

| Length cm. | Burning Time Seconds | Burning Rate cm/sec. | Pressure, N/cm$^2$ Initial | Pressure, N/cm$^2$ Final |
|---|---|---|---|---|
| 0.620 | 1.04 | 1.514 | 621.89 | 783.51 |
| 0.625 | 1.06 | 1.499 | 620.89 | 768.22 |
| Average | 1.05 | 1.506 | 621.39 | 775.87 |
| Range of Burning Rates (cm/sec) | | .015 | | |

TABLE V (Formula C)

| Length cm. | Burning Time Seconds | Burning Rate cm/sec. | Pressure, N/cm² Initial | Final |
|---|---|---|---|---|
| 1.667 | 2.546 | 0.655 | 620.56 | 746.60 |
| 1.608 | 2.730 | 0.589 | 620.89 | 746.60 |
| Average | 2.638 | 0.622 | 620.73 | 746.60 |
| Range of Burning Rates (cm/sec) | | .066 | | |

TABLE VI (Formula D)

| Length cm. | Burning Time Seconds | Burning Rate cm/sec. | Pressure, N/cm² Initial | Final |
|---|---|---|---|---|
| 1.631 | 4.210 | 0.386 | 622.56 | 675.77 |
| 1.582 | 0.130* | — | — | — |

*data discarded; no average taken

TABLE VII (Formula E)

| Length cm. | Burning Time Seconds | Burning Rate cm/sec. | Pressure, N/cm² Initial | Final |
|---|---|---|---|---|
| 1.148 | 0.573 | 2.004 | 620.89 | 755.24 |
| 1.140 | 0.567 | 2.011 | 622.89 | 750.26 |
| 1.138 | 0.570 | 1.997 | 620.23 | 755.24 |
| Average | 0.571 | 2.004 | 621.34 | 753.58 |
| Range of Burning Rates (cm/sec) | | .014 | | |

TABLE VIII (Formula F)

| Length cm. | Burning Time Seconds | Burning Rate cm/sec. | Pressure, N/cm² Initial | Final |
|---|---|---|---|---|
| 1.369 | 1.296 | 1.057 | 621.89 | 812.78 |
| 1.356 | 1.257 | 1.080 | 624.22 | 809.12 |
| Average | 1.276 | 1.069 | 622.78 | 810.95 |
| Range of Burning Rates (cm/sec) | | .023 | | |

TABLE IX (Formula G)

| Length cm. | Burning Time Seconds | Burning Rate cm/sec. | Pressure N/cm² Initial | Final |
|---|---|---|---|---|
| 1.427 | 0.882 | 1.618 | 624.55 | 844.04 |
| 1.605 | 1.058 | 1.516 | 626.55 | 859.68 |
| Average | 0.970 | 1.567 | 625.55 | 851.86 |
| Range of Burning Rates (cm/sec) | | 0.102 | | |

What is claimed is:

1. A composition comprising:

A. from about 25% to about 75% by weight of a heterocyclic compound having the structure:

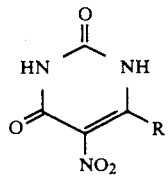

wherein R is selected from the group consisting of hydrogen, $-CO_2X$, and $-OX$ and X is a cation selected from metals of Group I-A of the Periodic Table (except sodium), calcium, strontium, or barium;

B. from about 25% to about 75% by weight of an anhydrous oxidizing salt having a cation selected from metals of Group I-A of the Periodic Table (except sodium), calcium, strontium, or barium, said salt having an anion which is essentially free of carbon, hydrogen or halogens; and C. from 0 to about 5% by weight of a binder.

2. The composition of claim 1, wherein R is —OX.

3. The composition of claim 1, wherein R. is $-O^-K^+$.

4. The composition of claim 1, wherein said anion is selected from the group consisting of nitrate, nitrite, and hexanitrocobaltate.

5. The composition of claim 1, wherein said anion is nitrate.

6. The composition of claim 1, wherein said anhydrous oxidizing salt is strontium nitrate.

7. The composition of claim 1, wherein said anhydrous oxidizing salt is potassium nitrate.

8. The composition of claim 1, wherein said binder is polypropylene carbonate.

9. The composition of claim 1, wherein said binder is molybdenum disulfide.

10. The composition of claim 1, comprising a salt of 5-nitrobarbituric acid as said heterocyclic compound, strontium nitrate as said anhydrous oxidizing salt, and polypropylene carbonate as said binder.

11. The composition of claim 10, wherein said heterocyclic compound is potassium 5-nitrobarbiturate.

12. The composition of claim 1, comprising a salt of 5-nitrobarbituric acid as said heterocyclic compound, potassium nitrate as said anhydrous oxidizing salt, and molybdenum disulfide as said binder.

13. The composition of claim 12, wherein said heterocyclic compound is potassium 5-nitrobarbiturate.

14. The composition of claim 1 comprising from about 40% to about 60% by weight of said heterocyclic compound and from about 40% to about 60% by weight of said oxidizing salt.

15. The composition of claim 1, comprising:

A. about 48% by weight potassium 5-nitrobarbiturate as said heterocyclic compound;

B. about 50% by weight strontium nitrate as said anhydrous oxidizing salt; and

C. about 2% by weight polypropylene carbonate as said binder.

16. The composition of claim 1, comprising:

A. about 50% by weight potassium 5-nitrobarbiturate as said cyclic compound;

B. about 48% by weight potassium nitrate as said oxidizing salt; and

C. about 2% by weight molybdenum disulfide as said binder.

17. A method for generating gas, comprising the step of igniting the composition of claim 1.

* * * * *